US010309077B2

(12) United States Patent
Kim et al.

(10) Patent No.: US 10,309,077 B2
(45) Date of Patent: Jun. 4, 2019

(54) MANHOLE COVER TYPE OMNIDIRECTIONAL ANTENNA

(71) Applicant: Electronics and Telecommunications Research Institute, Daejeon (KR)

(72) Inventors: Eun Hee Kim, Daejeon (KR); Ju Derk Park, Daejeon (KR); In Hwan Lee, Daejeon (KR); Ho Yong Kang, Daejeon (KR); Jae Heum Lee, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 245 days.

(21) Appl. No.: 15/361,098

(22) Filed: Nov. 25, 2016

(65) Prior Publication Data

US 2017/0155191 A1 Jun. 1, 2017

(30) Foreign Application Priority Data

Nov. 27, 2015 (KR) ..... 10-2015-0167737
Apr. 4, 2016 (KR) ..... 10-2016-0041101

(51) Int. Cl.

| | |
|---|---|
| ***H01Q 1/04*** | (2006.01) |
| ***E02D 29/14*** | (2006.01) |
| ***H01Q 1/40*** | (2006.01) |
| ***H01Q 9/04*** | (2006.01) |
| ***H01Q 5/364*** | (2015.01) |

(52) U.S. Cl.

CPC ..... *E02D 29/14* (2013.01); *H01Q 1/04* (2013.01); *H01Q 1/40* (2013.01); *H01Q 5/364* (2015.01); *H01Q 9/0421* (2013.01)

(58) Field of Classification Search

CPC ..... H01Q 1/40
See application file for complete search history.

(56) References Cited

U.S. PATENT DOCUMENTS

| | | | | |
|---|---|---|---|---|
| 2001/0011009 | A1* | 8/2001 | Harada | G02B 6/4451 455/40 |
| 2010/0090903 | A1* | 4/2010 | Byun | H01Q 9/0407 343/700 MS |
| 2012/0086603 | A1 | 4/2012 | Park et al. | |

FOREIGN PATENT DOCUMENTS

| | | | |
|---|---|---|---|
| KR | 10-2007-0089468 | A | 8/2007 |
| WO | WO-2007/111411 | A1 | 10/2007 |

* cited by examiner

*Primary Examiner* — Graham P Smith
(74) *Attorney, Agent, or Firm* — Rabin & Berdo, P.C.

(57) ABSTRACT

Disclosed is a manhole type omnidirectional antenna having a relatively small angle between a main beam direction and the Earth's surface and exhibiting omnidirectional characteristics to allow long-range communication, wherein the manhole type omnidirectional antenna includes a manhole cover installed in a manhole in the Earth's surface; a main body installed in a cavity of an upper surface of the manhole cover and configured to convert an electrical signal into an electromagnetic wave to wirelessly communicate with a gateway separated from the manhole cover; and a radome inserted into the cavity to cover the main body.

19 Claims, 13 Drawing Sheets

MANHOLE COVER TYPE OMNIDIRECTIONAL ANTENNA

CROSS-REFERENCE TO RELATED APPLICATION

This application claims priority to and the benefit of Korean Patent Application No. 2015-0167737, filed on Nov. 27, 2015 and No. 2016-0041101, filed on Apr. 4, 2016, the disclosures of which are incorporated herein by reference in its entirety.

BACKGROUND

1. Field of the Invention

The present invention relates to a manhole cover type omnidirectional antenna, and more particularly, to a manhole cover type omnidirectional antenna installed in a manhole cover of a manhole horizontally disposed to correspond to the Earth's surface to remotely collect and manage various types of sensing information under the ground and configured as a wireless sensor network or a wireless wide area network for communicating with a gateway above the ground.

2. Discussion of Related Art

Generally, a manhole cover installed on the Earth's surface is installed in a metal medium such as iron, zinc or the like, and the manhole cover needs to have a structure which does not protrude from the Earth's surface to prevent damage, performance degradation, etc. due to external environment.

Types of antennas applicable to the manhole cover include a patch antenna in a planar type structure, a small-sized dielectric antenna, and the like.

In addition, as a technology that establishes a system by applying such a common antenna, for example, there is a technology disclosed in United States Patent Laid-Open Publication No. US20010011009 entitled "Underground Information Communication System and Related Manhole Cover."

However, a plurality of manhole cover antennas installed at arbitrary locations need to be able to wirelessly communicate with a gateway on the ground. A manhole cover antenna requires omnidirectional characteristics from a horizontal plane. Here, long-distance communication efficiency can be relatively increased as an angle formed by a main beam direction from a vertical plane and the Earth's surface is decreased.

In the case when an antenna main body is installed inside a manhole apparatus without having a portion protruding from an upper surface of the manhole, the manhole apparatus manufactured of a metal influences designed radiation characteristics and radiation gain of the antenna main body. As a result, realizing a high performance antenna while having a small radiation angle with respect to the Earth's surface becomes very difficult.

FIG. 1 shows availability of communication depending on a difference in a main beam direction according to a conventional technology.

Referring to FIG. 1, there are a first sensor node 10 and a second sensor node 20 in an underground space U at a lower level than the Earth's surface S. The first sensor node 10 and the second sensor node 20 are electrically and respectively connected to internal antennas 13 and 23 installed in manhole covers 11 and 21.

A gateway 30 and a gateway antenna 31 are installed at a predetermined location in a region in which a plurality of manhole covers 11 and 21 are located to communicate with the first sensor node 10 or the second sensor node 20. Particularly, the gateway antenna 31 is located at a predetermined height h from the Earth's surface S.

In the case in which the internal antenna 13 or 23 for the first sensor node 10 or the second sensor node 20 is installed in the manhole cover 11 or 21, the internal antenna 13 or 23 is at an equivalent level with the Earth's surface S. When the height h of the gateway 30 or gateway antenna 31 located is considered, the internal antennas 13 and 23 cannot have omnidirectional characteristics.

Radiation 22 performed by the internal antenna 23 of the manhole cover 21 connected to the second sensor node 20 is formed along a direction perpendicular to the Earth's surface S (for example, a right angle).

As a comparative example, radiation 12 performed by the internal antenna 13 of the manhole cover 11 connected to the first sensor node 10 can be formed along a direction corresponding to an inclination angle relatively smaller than the right angle with respect to the Earth's surface S.

Here, although distances g from the gateway 30) to the first sensor node 10 and to the second sensor node 20 are the same, actual communication distances L1 and L2 can be different depending on directions and angles of the radiations 12 and 22.

Meanwhile, as a conventional technology, the most typical antenna of an omnidirectional antenna is a monopole antenna. Generally, the monopole antenna is installed perpendicular to the Earth's surface. Therefore, the monopole antenna has difficulty in being operated inside a manhole cover formed of a metal.

On the other hand, a patch antenna, a planar antenna, and a small-sized dielectric antenna can be easily installed in a manhole cover.

However, when such a patch antenna, a planar antenna, or a small-sized dielectric antenna is installed inside a manhole cover or inside a manhole, difficulties can be faced due to not obtaining omnidirectional characteristics therefrom. Accordingly, development of an antenna having a structure by which radiation characteristics of the antenna is improved while being easily applicable to a manhole cover is urgently required.

SUMMARY OF THE INVENTION

The present invention is directed to providing a manhole cover type omnidirectional antenna having a planar-type multi-plate structure capable of being horizontally installed inside a manhole cover at an equivalent level with the Earth's surface and performing long range communication due to a relatively small angle formed between a main beam direction and the Earth's surface and omnidirectional characteristics.

The present invention is also directed to providing a manhole cover type omnidirectional antenna capable of implementing a radiation angle formed with respect to the Earth's surface to be relatively small and easily establishing a wireless wide area network compared to a conventional antenna with a single substrate, when the manhole cover type omnidirectional antenna is buried in a manhole through a main body serving as an antenna in a structure described below.

According to an aspect of the present invention, there is provided a manhole cover type omnidirectional antenna including: a manhole cover installed in a manhole in the Earth's surface; a main body installed in a cavity of an upper surface of the manhole cover and configured to convert an electrical signal into an electromagnetic wave to wirelessly communicate with a gateway separated from the manhole cover; and a radome inserted into the cavity to cover the main body.

The manhole cover type omnidirectional antenna may further include a connector connected to a cable which electrically connects the main body and a wireless transmitter.

The main body in a monopole shape thinner than a thickness of the manhole cover may achieve impedance matching using a shorting strip to have an antenna performance in which an angle of a main beam direction with respect to the Earth's surface is small, and slots may be symmetrically disposed in a direction perpendicular to an arrangement direction of the shorting strips so that the main body has omnidirectional characteristics at a horizontal plane.

The wireless transmitter may be connected to a plurality of sensors disposed inside the manhole and provide the electrical signal corresponding to sensing information input from the sensors to the main body via the cable and the connector.

The cavity may include a circular side surface disposed in the manhole cover and having a cavity diameter smaller than a diameter of the manhole cover but greater than a diameter of the main body, a lower surface horizontally connected to the side surface at a smaller depth than a thickness of the manhole cover, and a cable hole through which the connector is inserted or the cable is passed.

The main body may have a main body diameter formed to be smaller than the cavity diameter.

The main body may include a lower plate disposed on a lower surface of the cavity of the manhole cover on the basis of a cable hole of the manhole cover into which the connector is inserted and configured to serve as a ground surface, a metal pole which extends from the connector, passes through the lower plate, and extends in a vertical direction up to a height corresponding to a gap between plates, an upper plate connected to an upper end of the metal pole, maintained in parallel to the lower plate, having the same main body diameter as the lower plate, and configured to serve as a radiator, a shorting strip which connects the upper plate and the lower plate at a position spaced apart from the metal pole, and a slot formed in the upper plate to be spaced apart from the metal pole on the basis of a position not overlapping the shorting strip.

The upper plate may use a point at which the upper plate and the upper end of the metal pole are connected to each other as a feeding point.

The upper plate may be short-circuited with respect to the lower plate through the shorting strip.

The main body may be formed as a planar-type multi-plate structure by the upper plate and the lower plate parallel to each other with the metal pole and the shorting strip interposed therebetween.

The main body may convert the electrical signal received from the connector into the electromagnetic wave corresponding to a shape of the planar-type multi-plate structure to form a small angle between the main beam direction of the electromagnetic wave and the Earth's surface and to have omnidirectional characteristics.

The main body may form a large area information network over a network.

An upper portion of the shorting strip may be inserted into an upper connection hole of the upper plate and a lower portion of the shorting strip may be inserted into a lower connection hole of the lower plate, to be fixed by welding.

According to another aspect of the present invention, there is provided a manhole cover type omnidirectional antenna including: a lower plate installed in a cavity of an upper surface of a manhole cover; a connector installed at the lower plate and connected to a cable for a wireless transmitter; a metal pole with a lower end thereof connected to the connector which passes through the lower plate and extends in a vertical direction up to a height corresponding to a gap between plates; an upper plate connected to an upper end of the metal pole, maintained in parallel to the lower plate, and configured to serve as a radiator; a shorting strip which connects the upper plate and the lower plate at a position spaced apart from the metal pole; and a radome inserted into the cavity to cover the main body.

The radome may further include a coupling cavity portion having a diameter and thickness which correspond to those of the cavity and formed in the radome to accommodate the upper plate, the lower plate, the metal pole, and the shorting strip.

The upper plate may include a slot formed in the upper plate to be spaced apart from the metal pole on the basis of a place not overlapping the shorting strip.

The shorting strip may include a short circuit portion which short-circuits the upper plate and the lower plate, and a pillar portion in contact with a lower surface or an upper surface of the upper plate and an upper surface or a lower surface of the lower plate and configured to support the upper plate on the basis of the lower plate.

The upper plate may include a first substrate supported by the shorting strip, formed in a circular shape and configured to serve as a dielectric, and a circular patch portion attached to an upper surface of the first substrate and having a feeding pattern connected to the metal pole and a radiation pattern connected to the feeding pattern to convert an electrical signal into an electromagnetic wave.

The lower plate may include a second substrate disposed separately from a lower side of the upper plate by the shorting strip, and a ground surface attached to a lower surface or upper surface of the second substrate and electrically connected to the short circuit portion of the shorting strips.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Advantages and features of the present invention and methods of accomplishing them will be made apparent with reference to the accompanying drawings and some embodiments to be described below. The present invention may, however, be embodied in different forms and should not be construed as limited to the embodiments set forth herein. Rather, the embodiments are provided so that this disclosure is thorough and complete and fully conveys the inventive concept to those skilled in the art, and the present invention should only be defined by the appended claims.

Meanwhile, the terminology used herein is for the purpose of describing particular embodiments only and is not intended to limit the present invention. As used herein, the singular forms "a," "an," and "the" are intended to include the plural forms as well, unless the context clearly indicates otherwise. It will be further understood that the terms "comprises," and/or "comprising" when used herein, specify the presence of stated features, integers, steps, operations, elements, and/or components, but do not preclude the presence or addition of one or more other features, integers, steps, operations, elements, components, and/or groups thereof. Hereinafter, embodiments of the present invention will be described in detail with reference to accompanying drawings.

First Embodiment

Figure 2:
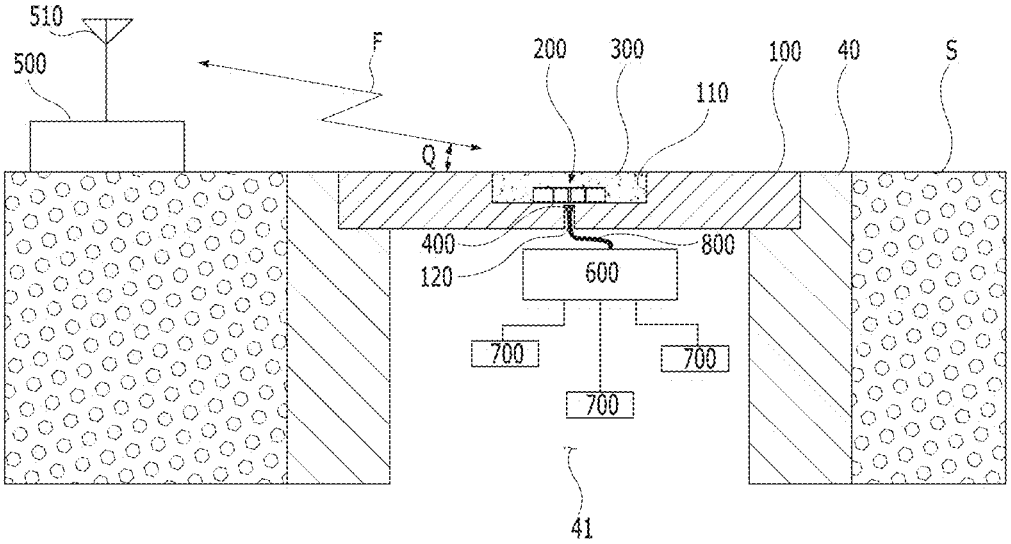
FIG. 2 is a configuration view illustrating a wireless sensor network using a manhole cover type omnidirectional antenna according to a first embodiment of the present invention.

FIG. 2 is a configuration view illustrating a wireless sensor network using a manhole cover type omnidirectional antenna according to a first embodiment of the present invention. As a more detailed description, FIG. 2 shows a configuration of a wireless sensor network in which a main body 200 serving as an antenna is installed in a manhole cover 100 installed at the Earth's surface S. Here, the wireless sensor network may include a wireless wide area network.

Referring to FIG. 2, the first embodiment includes the manhole cover 100, the main body 200, a radome 300, a connector 400.

The manhole cover 100 is installed in a manhole 40 on the Earth's surface S and may be disposed at a step at an edge of an upper opened hole of the manhole 40 to cover the upper opened hole of the manhole 40 or to be openable.

The main body 200 refers to the manhole cover type omnidirectional antenna according to the first embodiment.

That is, the main body 200 is in a monopole shape whose thickness is smaller than a thickness of the manhole cover 100 and exhibits the performance of an antenna having a small angle formed between a main beam direction and the Earth's surface.

The main body 200 is mounted or installed in a cavity 110 of an upper surface of the manhole cover 100. The main body 200 serves to convert electrical signals into electromagnetic waves so that the main body 200 performs wireless communication with a gateway 500 separated from the manhole cover 100. Here, a gateway antenna 510 may be installed on or around the gateway 500 above the ground.

The main body 200, by components, a structure, and connection relations which will be described below, may have a relatively small angle Q (for example, a radiation angle) formed between the main beam direction F and the Earth's surface S and exhibit omnidirectional characteristics compared to conventional antenna products.

By such a main body 200, the gateway 500 may perform smooth communication with the main body 200 even when the gateway 500 is installed at a location of a relatively low height such as the Earth's surface S or the like.

The radome 300 may be inserted or filled in the cavity 110 to cover the main body 200, in which the radome 300 may be maintained at the same level as the upper surface of the manhole cover 100. Here, the main body 200 serving as an antenna is covered by the radome 300.

The radome 300 may be formed of a solid dielectric of a nonmetallic substance. Here, the dielectric is a nonconductor having a dielectric constant higher than a dielectric constant of air. As the dielectric constant becomes higher, polarization with respect to a radio frequency (RF) occurs more often. The dielectric may be formed of any one of polycarbonate, acryl, ceramic, printed writing boards (PWBs), and Teflon.

The connector 400 may be disposed at a central position of a lower portion of the main body 200 depending on design.

In addition, the connector 400 may be at a different position to which the main body 200 may be connected and in a different direction. That is, the connector 400 may be connected to the main body 200 at another position or in another direction of the main body 200 besides at the central position or in the lower direction of the main body 200.

A wireless transmitter 600 is positioned in an underground space 41 of the manhole 40 having a hollow-type structure.

The wireless transmitter 600 may be connected to a plurality of sensors 700 disposed in the manhole 40 or underground space 41.

The wireless transmitter 600 may provide the main body with an electrical signal which corresponds to sensing information input from sensors 700 via a cable 800 and the connector 400. Here, the connector 400 may be inserted into a cable hole 120 of the manhole cover 100, connected to the cable 800, and fixed using an adhesive, molding materials, or the like.

The sensors 700 refer to a plurality of sensor nodes and may be provided at sensing objects (not shown) already installed at the underground space 41.

The sensors 700 are connected to the wireless transmitter 600 by wires or wireless communication. Each of the sensors 700 collects sensor information of the sensing object in charge and transfers the sensor information to the wireless transmitter 600.

The wireless transmitter 600 is connected to the connector 400 of the main body 200 through the cable 800 serving as a RF channel Here, the connector 400 is connected to the main body 200 installed in the cavity 110 of the manhole cover 100. For example, the connector 400 is disposed at a lower portion of the main body 200 and protrudes downward from the main body 200 to be connected to the cable 800 which electrically connects the main body 200 and the wireless transmitter 600.

The wireless transmitter 600 may wirelessly transmit the sensing information to the gateway 500 on the ground or receive a signal from the gateway 500 via the cable 800, the connector 400, and the main body 200.

As described above, the main body 200 may be easily installed in the manhole cover 100 in a planar-type metal-structure for an exemplary wireless sensor network or wireless wide area network as illustrated in FIG. 2.

Figure 1:
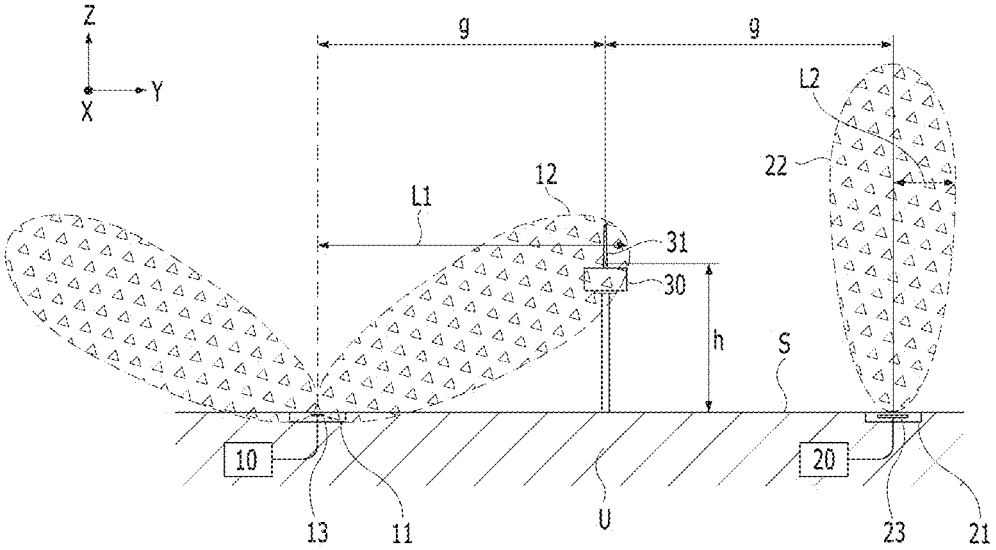
FIG. 1 is a schematic configuration view illustrating availability of communication depending on a difference in main beam direction according to a conventional technology.

In addition, when compared to the exemplary radiation 22 illustrated in FIG. 1, the angle Q formed by the main beam direction F with respect to the Earth's surface S is designed to be similar to or smaller than the angle formed by another exemplary radiation 12 illustrated in FIG. 1 to exhibit omnidirectional antenna characteristics.

Figure 3:
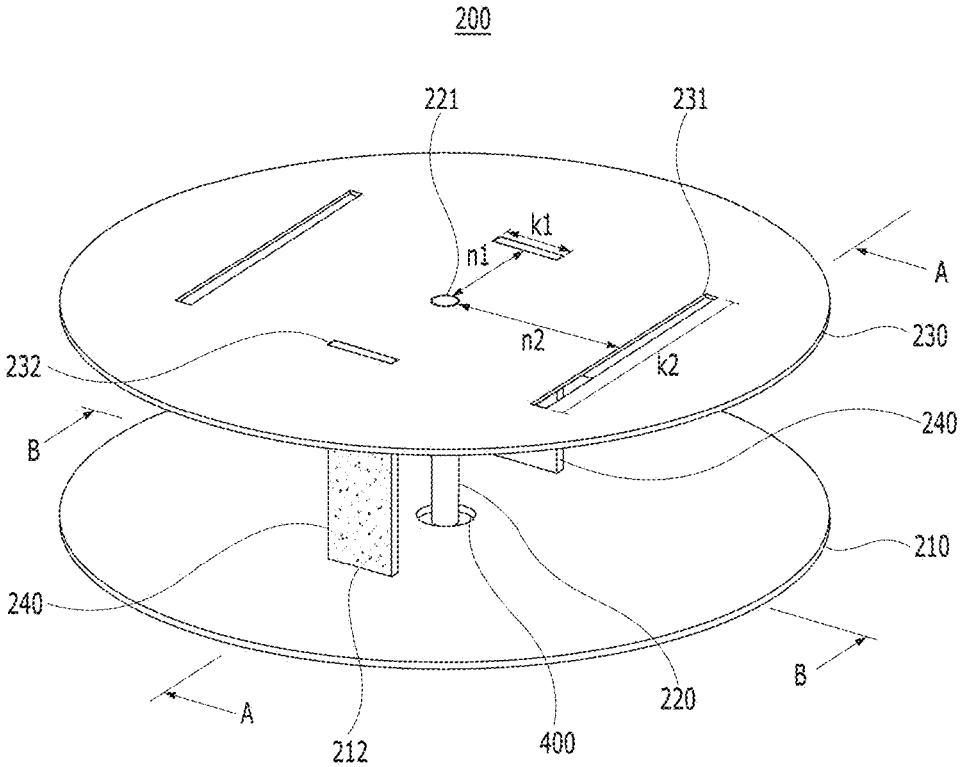
FIG. 3 is a perspective view illustrating a main body of the manhole cover type omnidirectional antenna shown in FIG. 2.
Figure 4:
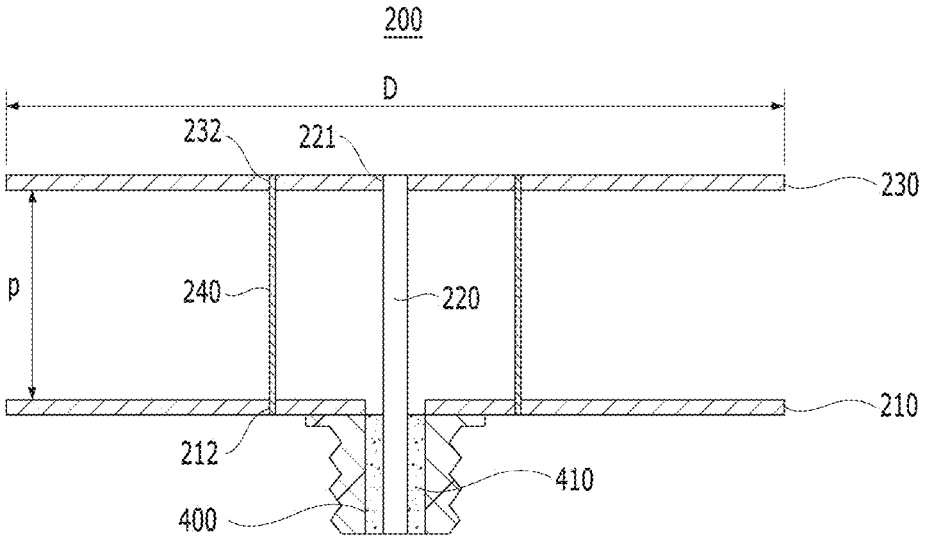
FIG. 4 is a cross-sectional view taken along line A-A of FIG. 3.
Figure 5:
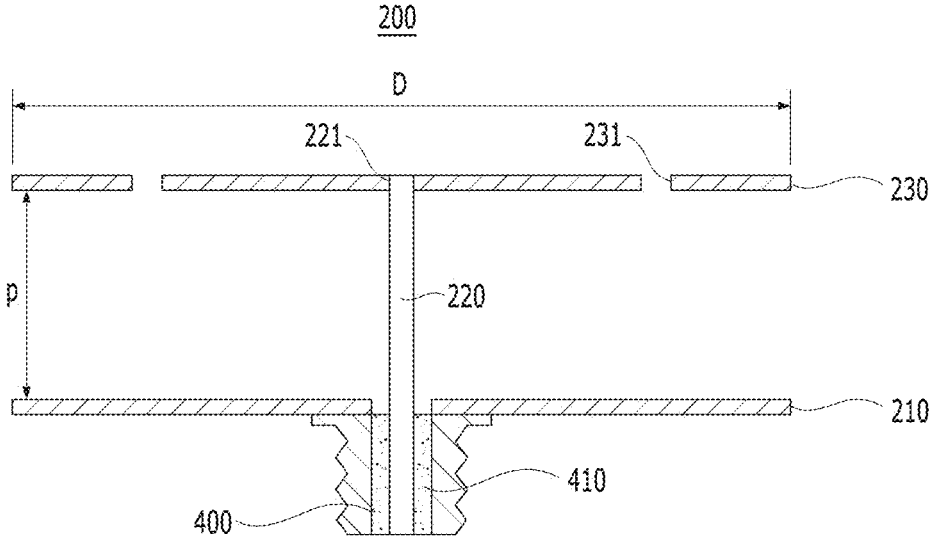
FIG. 5 is a cross-sectional view taken along line B-B of FIG. 3.

FIG. 3 is a perspective view illustrating a main body of the manhole cover type omnidirectional antenna shown in FIG. 2, FIG. 4 is a cross-sectional view taken along line A-A of FIG. 3, and FIG. 5 is a cross-sectional view taken along line B-B of FIG. 3.

Referring to FIGS. 3 and 4, the main body 200 may be formed including a lower plate 210, a metal pole 220, an upper plate 230, and shorting strips 240.

As components of the main body 200, the lower plate 210, the metal pole 220, the upper plate 230, and the shorting strips 240 may correspond to metal portions in which a surface current flows.

The lower plate 210 or upper plate 230 may be formed in a circular shape but may also be formed in any one of various shapes such as a tetragonal shape, a hexagonal shape, a polygonal shape or the like depending on design, and may not be limited to a particular shape.

The shorting strips 240 may be formed in a pair as illustrated in the drawings and may also be formed in a plurality of shorting strips depending on design.

A height p of the shorting strip 240 or a distance between the lower plate 210 and the upper plate 230 may be determined in consideration of impedance matching.

A pair or one or more of slots 231 are symmetrically or unsymmetrically positioned in the upper plate 230 serving as a radiator and a feeding point 221 is positioned at the upper plate 230. Here, a shape and the number of the slots 231 may be different depending on design, and although a pair of the slots 231 is illustrated in FIG. 3 as an example, the slots 231 may be formed in plural slots, at multiple positions, and in a structure of an unsymmetrical arrangement.

The shorting strips 240 also are symmetrically or unsymmetrically disposed between the upper plate 230 serving as a radiator and the lower plate 210. Power feeding to the upper plate 230 may be performed through the metal pole 220 which is a core of the connector 400.

The lower plate 210 is disposed at a lower surface of the cavity 110 of the manhole cover 100 on the basis of the cable hole 120 of the manhole cover 100 illustrated in FIG. 2 and serves as a ground surface.

The metal pole 220 is the core of the connector 400 as described above and may be a feeding probe. A lower end of the metal pole 220 extends from the connector 400. Here, the connector 400 may be formed including a core portion 410 provided inside a body of the connector 400 and the metal pole 220 disposed inside the core portion 410.

Even though the metal pole 220 is not necessarily at a central position of the lower plate 210 and the upper plate 230, the metal pole 220 may play a role in power feeding as long as the metal pole 220 is at a position which may connect the lower plate 210 and the upper plate 230 depending on design.

The core portion 410 may serve to physically support the metal pole 220 and pass an electric current. A screw thread portion formed on an outer side of the core portion 410 of the connector 400 may be coupled to a connection portion of the cable to form a state in which an electric current may pass.

The metal pole 220 passes through the lower plate 210 and extends in a vertical direction up to an upper end with a height corresponding to the distance between the two plates.

The upper plate 230 is connected to the upper end of the metal pole 220, maintained parallel to the lower plate 210, and serves as a radiator.

The upper plate 230 may have the same main body diameter D as the lower plate 210 or may also be manufactured in a size different from that of the lower plate 210.

The point at which the upper plate 230 and the upper end of the metal pole 220 are connected to each other is used as the feeding point 221.

Figure 6:
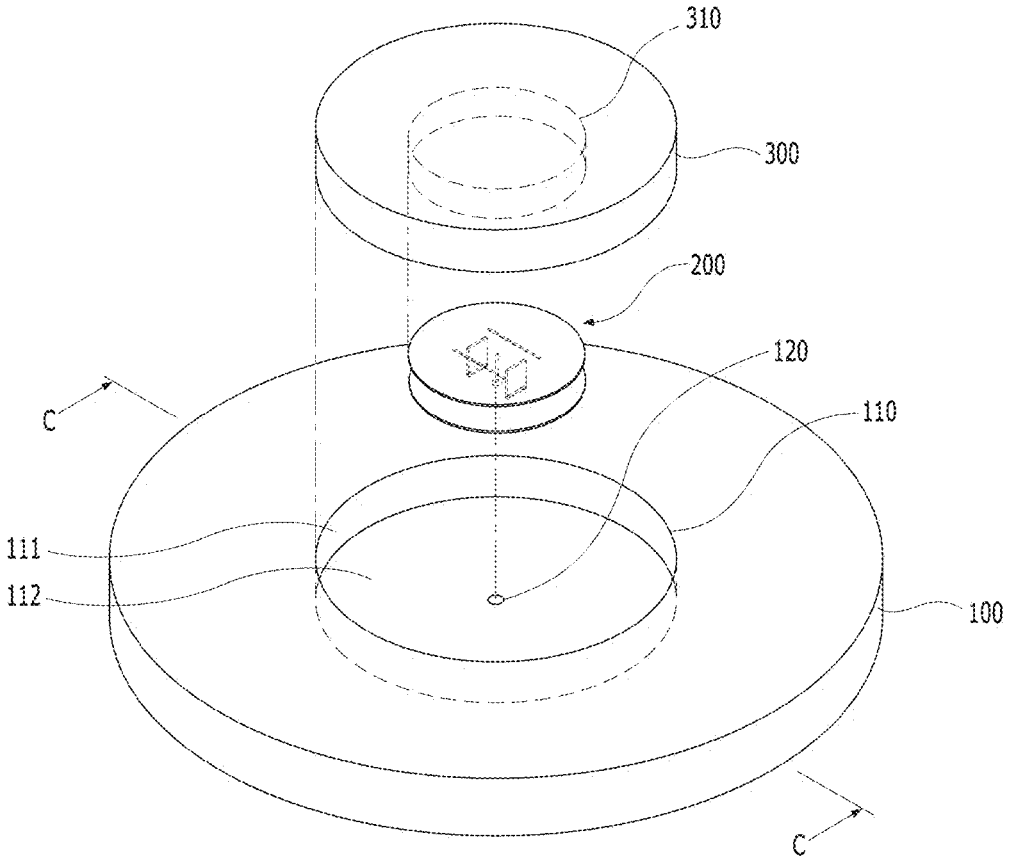
FIG. 6 is an exploded perspective view for describing a coupling configuration of a main body, a manhole cover and a radome which are shown in FIG. 2.

As an example, the main body diameter D refers to a diameter of the main body 200 or a diameter of the upper plate 230, and is formed to be smaller than a diameter of the cavity 110 of the manhole cover 100 illustrated in FIG. 6. For example, the main body diameter D may correspond to any one size selected from a numerical range of 6 to 30 cm.

Here, the numerical value of the main body diameter D or a main body size may not be limited to a particular numerical value. That is, the numerical value of the main body diameter D or the main body size may be set in consideration of a wavelength of a frequency using the antenna. As an additional description, the minimum diameter size of the above numerical range may not be set only to 6 cm. That is, because frequency is inversely proportional to wavelength, for example, the main body 200 may be manufactured in a smaller size when an applicable frequency band goes up to the 2.4 GHz band.

In addition, the maximum diameter size of the above numerical range may not be limited to 30 cm because the maximum diameter size of the main body only needs to be smaller than or equal to a diameter of the manhole.

The shorting strip 240 is disposed between the upper plate 230 and the lower plate 210 and connects the upper plate 230 and the lower plate 210 at a position spaced apart from the metal pole 220.

The shorting strip 240 is formed of a conductive substance or material and is electrically connected to the upper plate 230 and the lower plate 210 using soldering.

In addition, as illustrated in FIG. 3, the antenna according to the first embodiment is provided with the metal pole 220 positioned at a center of a circular patch (not shown) or the upper plate 230, the feeding point 221 by which power feeding is performed, and the shorting strip 240 for impedance matching.

A planar type antenna with a conventional technology simply used one or more pieces of shorting strips (or short pins) normally without any particular layout rule for impedance matching, wherein, when a radio wave is applied by a pole of the planar type antenna with a conventional technology, a surface current is formed at an upper radiating portion of a disc of the planar type antenna with a conventional technology and a radiation shape is determined according to a distribution of the surface current.

In the first embodiment, to implement a radiation structure exhibiting omnidirectional characteristics, first, the shorting strips 240 which connect the upper plate 230 serving as a radiating portion and the lower plate 210 serving as a ground surface are separately and symmetrically disposed with respect to the metal pole 220 or the feeding point 221.

Here, the impedance matching is achieved according to a length k1 of the shorting strip 240 and a separation distance n1 from the metal pole 220 or the feeding point 221 to the shorting strip 240. That is, the impedance matching is achieved by adjusting the length k1 of the shorting strip 240 symmetrically disposed and the separation distance n1 between the feeding point 221 and the shorting strip 240.

As described above, in the first embodiment, an angle between a radiation direction and the Earth's surface (for example, a radiation angle) may be very small by realizing an impedance matching to match characteristics of a monopole antenna in a thin shape.

Figure 15:
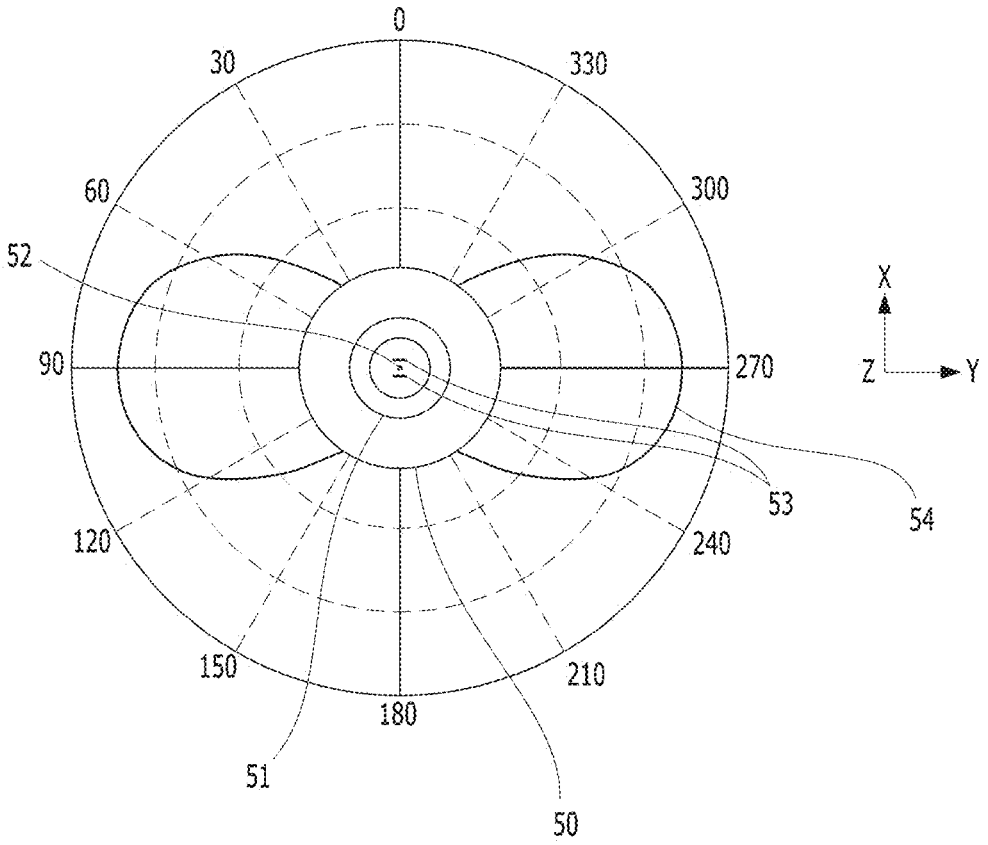
FIG. 15 is a graph for describing a formation shape of a radiation pattern of a conventional antenna according to a comparative example of the present invention.

However, with the structure described so far, radiation in an 8 shape is exhibited as the radiation shape of a horizontal plane (for example, an X-Y plane) illustrated in FIG. 15 and omnidirectional characteristics may not be exhibited. That is, a main radiation shape 54 is formed because the main beam direction is formed along both directions perpendicular to an arrangement direction of shorting strips 53 of a conventional technology, and such a main radiation shape 54 of the conventional technology may not exhibit omnidirectional characteristics.

To compensate for this, in the first embodiment, the slots 231 are symmetrically disposed in a direction perpendicular to an arrangement direction of the shorting strips 240 as will be described below.

Here, the main body may be designed to exhibit the omnidirectional characteristics on the horizontal plane (the Earth's surface or the X-Y plane) when a separation distance n2 from the metal pole 220 or the feeding point 221 corresponding to a center of the upper plate 230 to the slot 231 and a length k2 of the slot 231 are adjusted.

As shown in FIG. 3 or 4, upper end portions of the shorting strips 240 are inserted into or connected to upper connection holes 232 of the upper plate 230. Lower end portions of the shorting strips 240 are inserted into or connected to lower connection holes 212 of the lower plate 210. Here, for the connection, a welding or any other connection method for fixing which may allow a physical connection while maintaining an electrical connection may be used and thereby a state in which an electrical current may pass is obtained.

An arrangement direction of the upper connection holes 232 and lower connection holes 212 may be perpendicular to an arrangement direction of the slots 231.

The upper plate 230 is shorted with respect to the lower plate 210 by the shorting strips 240.

In addition, the slots 231 are formed in the upper plate 230 in a direction perpendicular to the arrangement direction of the shorting strips 240 or formed to be spaced apart from the metal pole 220 at positions not overlapping the shorting strips 240.

Each of the slots 231 is formed in the upper plate 230.

Each of the slots 231 has a relatively small width compared to a length thereof, and the length of the slot 231 is in a range of 25 to 30 times the width of the slot 231.

Here, the main body 200 is formed as a planar-type multi-plate structure by the upper plate 230 and the lower plate 210 being parallel to each other and the metal pole 220 and the shorting strips 240 interposed therebetween.

The main body 200 in a multi-plate structure having features of the slots 231 in an arrangement direction or shape converts electrical signals received via the connector 400 into electromagnetic waves corresponding to a shape of a planar-type multi-plate structure, and thereby the main body 200 exhibits the omnidirectional characteristics while having a small angle of the main beam direction of the electromagnetic waves with respect to the Earth's surface.

Accordingly, the main body 200 may establish a large area information network in a low power wireless sensor network or a wireless wide area network.

Figure 7:
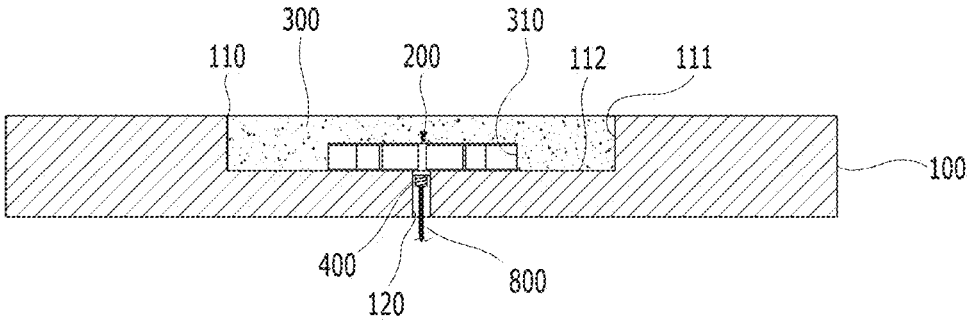
FIG. 7 is a cross-sectional view taken along line C-C of FIG. 6 in a state in which the main body, the manhole cover and the radome are coupled to one another.

FIG. 6 is an exploded perspective view for describing a coupling configuration of the main body, the manhole cover, and the radome which are shown in FIG. 2, and FIG. 7 is a cross-sectional view taken along line C-C of FIG. 6 in a state in which the main body, the manhole cover and the radome are coupled to one another.

Referring to FIGS. 6 and 7, the main body 200 may be installed in the manhole cover 100. Here, the main body 200 is inserted into a coupling cavity portion 310 of a lower surface of the radome 300 formed of a dielectric. In addition, the radome 300 having the main body 200 is inserted into the cavity 110 of the manhole cover 100 so that upper levels of the radome 300 and the manhole cover 100 may be horizontally maintained on the same plane. In addition, a ground portion of the main body 200 may be connected to a metal portion of the manhole cover 100 to be short-circuited.

The cavity 110 of the manhole cover 100 is disposed in the manhole cover 100. Here, the cavity 110 may not necessarily be a center of the manhole cover 100 and may be formed at any position of an upper plane of the manhole cover 100.

In addition, although a size and a diameter of the cavity 110 of the manhole cover 100 are smaller than a size and a diameter of the manhole cover 100, the cavity 110 of the manhole cover 100 includes a circular side surface 111 having a cavity diameter greater than the diameter of the main body 200. In addition, the cavity 110 includes a lower surface 112 which horizontally connects to the side surface 111 at a depth smaller than a thickness of the manhole cover 100. In addition, the cavity 110 may include the cable hole 120. Here, the above-described connector 400 may be inserted into the cable hole 120. In addition, the above-described cable 800 may pass through the cable hole 120.

The radome 300 has a diameter and a thickness corresponding to those of the cavity 110. The radome 300 may further include the coupling cavity portion 310 formed in the radome 300. The coupling cavity portion 310 may accommodate the upper plate, the lower plate, the metal pole and the shorting strips of the main body 200.

According to such structural and configurational features, the main body 200 and the radome 300 of the manhole cover 100 may be formed not to protrude from the upper surface of the manhole cover 100.

The main body 200 and the radome 300 of the manhole cover 100 may be components of a wireless sensor network or a wireless wide area network which connects an underground space and a ground space.

A user may wirelessly acquire sensing information associated with the manholes by the main body 200 and the radome 300 of the manhole cover 100 without needing to directly approach the manholes at locations on roads of a downtown area etc. which are not easy to approach. That is, the main body 200 and the radome 300 of the manhole cover 100 may ensure user safety.

Second Embodiment

A manhole cover type omnidirectional antenna of the present invention described in the present embodiment may be the same as or very similar to the manhole cover type omnidirectional antenna of the first embodiment except that a main body in a shape of a planar-type multi-plate structure is formed to be enhanced in durability and solidity due to a structural shape of a shorting strip. Therefore, the same or similar reference numbers will be marked for the same or corresponding components in FIGS. 2 to 17, and descriptions on the components herein will be omitted.

Figure 8:
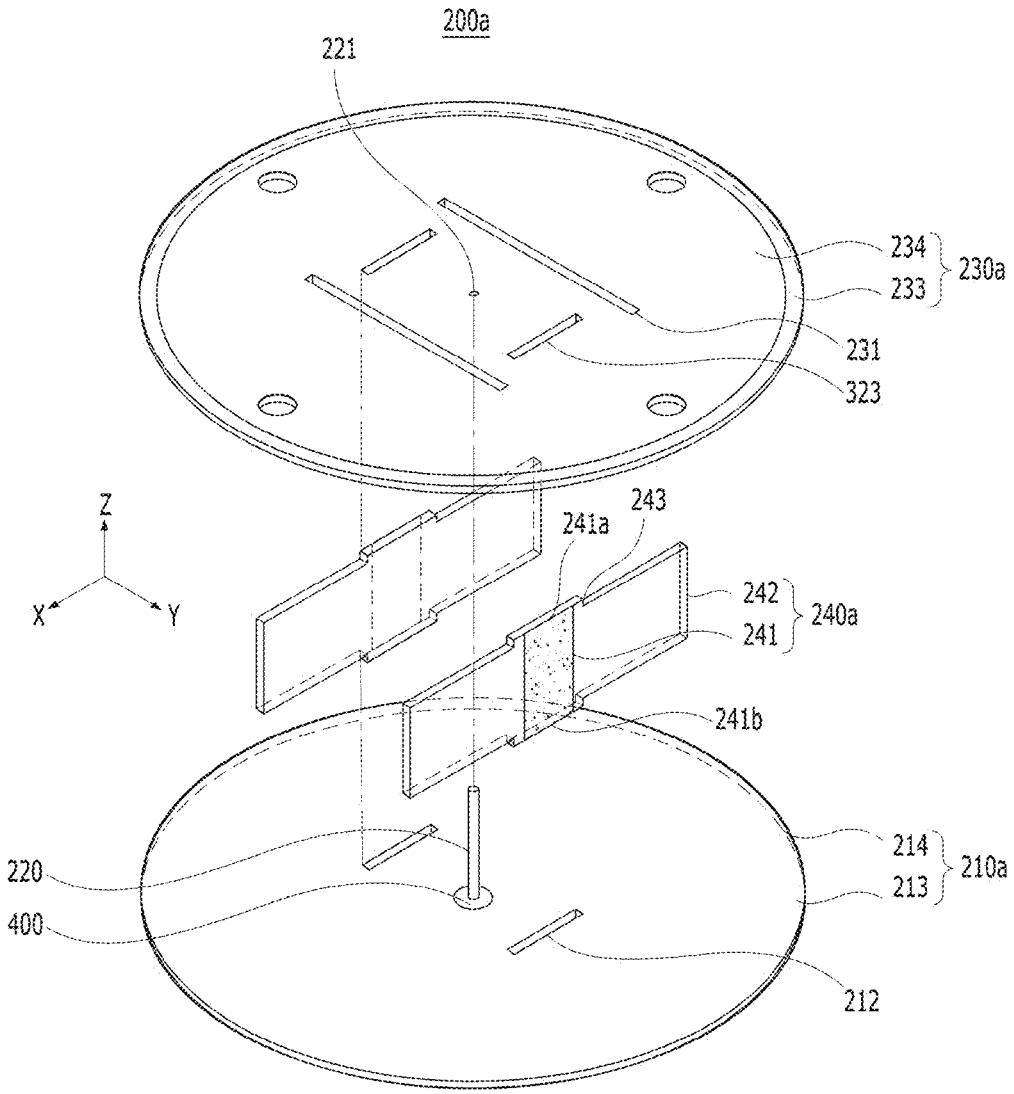
FIG. 8 is an exploded perspective view illustrating a main body of a manhole cover type omnidirectional antenna according to a second embodiment of the present invention.
Figure 9:
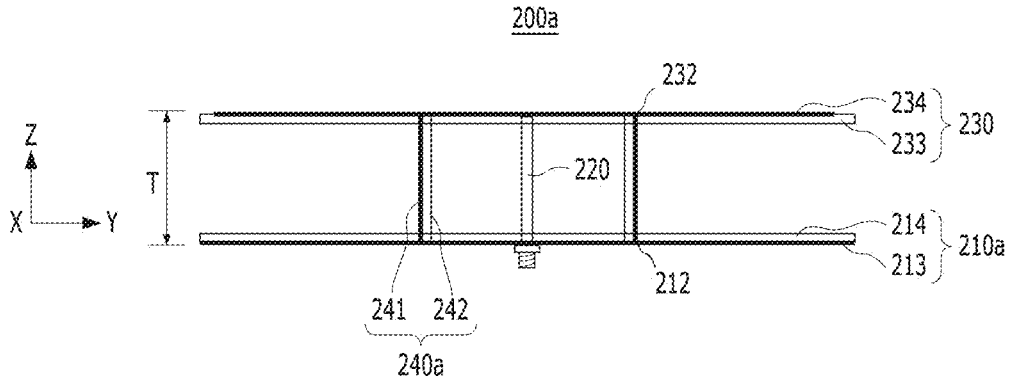
FIG. 9 is a cross-sectional view illustrating the main body shown in FIG. 8.

FIG. 8 is an exploded perspective view illustrating a main body of a manhole cover type omnidirectional antenna according to a second embodiment of the present invention, and FIG. 9 is a cross-sectional view of the main body illustrated in FIG. 8.

Referring to FIG. 8 or FIG. 9, a main body 200*a* is provided in the second embodiment, however, the main body 200*a* is installed in a cavity of an upper surface of a manhole cover and includes a lower plate 210*a* disposed at a lower surface of the cavity to wirelessly communicate with a gateway which is separated from the manhole cover.

The main body 200*a* includes a connector 400 which protrudes downward from the lower plate 210*a* or is disposed in the lower plate 210*a* and is connected to a cable for a wireless transmitter.

The main body 200*a* includes a metal pole 220. A lower end of the metal pole 220 may be connected to the connector 400. The metal pole 220 may vertically extend up to a height corresponding to a gap between the lower plate 210*a* and an upper plate 230*a* after passing through the lower plate 210*a*.

The main body 200*a* includes the upper plate 230*a*. The upper plate 230*a* may be connected to an upper end of the metal pole 220. The upper plate 230 is maintained in parallel to the lower plate 210*a* and serves as a radiator.

The main body 200*a* may include one or more shorting strips 240*a* which connect the upper plate 230*a* and the lower plate 210*a* at positions spaced apart from the metal pole 220.

The main body 200*a* of the second embodiment may also include a radome to cover the main body 200*a*. Here, the radome may be inserted into the cavity and maintained at the same level as an upper surface of the manhole cover.

The upper plate 230*a* may include slots 231 formed in the upper plate 230*a* to be spaced apart from the metal pole 220 at positions not overlapping the shorting strips 240*a*.

The shorting strips 240*a* may include short circuit portions 241 which short-circuit the upper plate 230*a* and the lower plate 210*a*.

The shorting strips 240*a* may include pillar portions 242. Here, the pillar portion 242 may be in contact with a lower surface or upper surface of the upper plate 230*a* or an upper surface or lower surface of the lower plate 210*a*, and support the upper plate 230*a* on the basis of the lower plate 210*a*.

A method of bringing an end of the pillar portions 242 into contact with the lower surface or upper surface of the upper plate 230*a* or the upper surface or lower surface of the lower plate 210*a* may be performed by a direct contact manner or welding method.

The pillar portions 242 may be integrated wing portions or integrated support structures which extend from the short circuit portions 241. The pillar portions 242 may be support structures disposed at positions spaced apart from the short circuit portions 241. The pillar portions 242 may serve to enhance durability and solidity of the main body 200*a*.

As illustrated in FIG. 8, the shorting strips 240*a* are provided with upper end portions 241*a* and lower end portions 241*b* so that the short circuit portions 241 protrude more upward and downward than the pillar portions 242.

Step portions 243 may be formed between the upper end portions 241*a* of the short circuit portions 241 and upper surfaces of the pillar portions 242, or between lower end portions 241*b* of the short circuit portions 241 and lower surfaces of the pillar portions 242.

Upper connection holes 232 are formed in the upper plate 230*a* for the upper end portions 241*a* of the shorting strips 240*a* to pass through the upper plate 230*a* in a thickness direction. An arrangement direction of the upper connection holes 232 may be perpendicular to an arrangement direction of the slots 231.

Lower connection holes 212 may also be formed in the lower plate 210*a* at positions aligned in a direction in which the upper end portions 241*a* of the shorting strips 240*a* pass through the upper connection holes 232.

The upper end portions 241*a* of the short circuit portions 241 are inserted into the upper connection holes 232 formed in the upper plate 230*a*, and the lower end portions 241*b* of the short circuit portions 241 are inserted into the lower connection holes 212 formed in the lower plate 210*a*. Here, each of the inserted portions may be fixed by welding.

The upper plate 230*a* of the second embodiment also is short-circuited with respect to the lower plate 210*a* through the short circuit portions 241 of the shorting strips 240*a*. Here, the short circuit portions 241 are formed of electrically conductive materials, circuit lines or circuit patterns not only for physically connecting the upper plate 230*a* and the lower plate 210*a* but also for electrically connecting them.

The upper plate 230*a* is configured with a first substrate 233 supported by the shorting strips 240*a*, formed in a circular shape, and configured to serve as a dielectric, and a circular patch portion 234 attached to an upper surface of the first substrate 233. Particularly, the circular patch portion 234 has a feeding pattern connected to the metal pole 220 and a radiation pattern connected to the feeding pattern to convert electrical signals into electromagnetic waves. Here, the feeding pattern and the radiation pattern may be determined to correspond to antenna characteristics and may not be limited to a particular pattern.

The lower plate 210*a* is configured with a second substrate 214 disposed separately from a lower side of the upper plate 230*a* by the shorting strips 240*a* and a ground surface 213 attached to a lower surface or upper surface of the second substrate 214 and electrically connected to the short circuit portions 241 of the shorting strips 240*a*.

Referring to FIG. 8 or 9, the main body 200*a* of the second embodiment is manufactured with the first substrate 233 and the second substrate 214 in the form of a printed circuit board (PCB) while applying components of the antenna thereto, to be operated even at an unlicensed frequency in a frequency band from 900 to 940 MHz.

Particularly, the main body 200*a* may be very easy to be mounted in or applied to an existing manhole cover by making a cavity therein because the main body 200 may be made as small as 1.2 cm in thickness T and implemented in a very small size compared to typical manhole covers.

Figure 10:
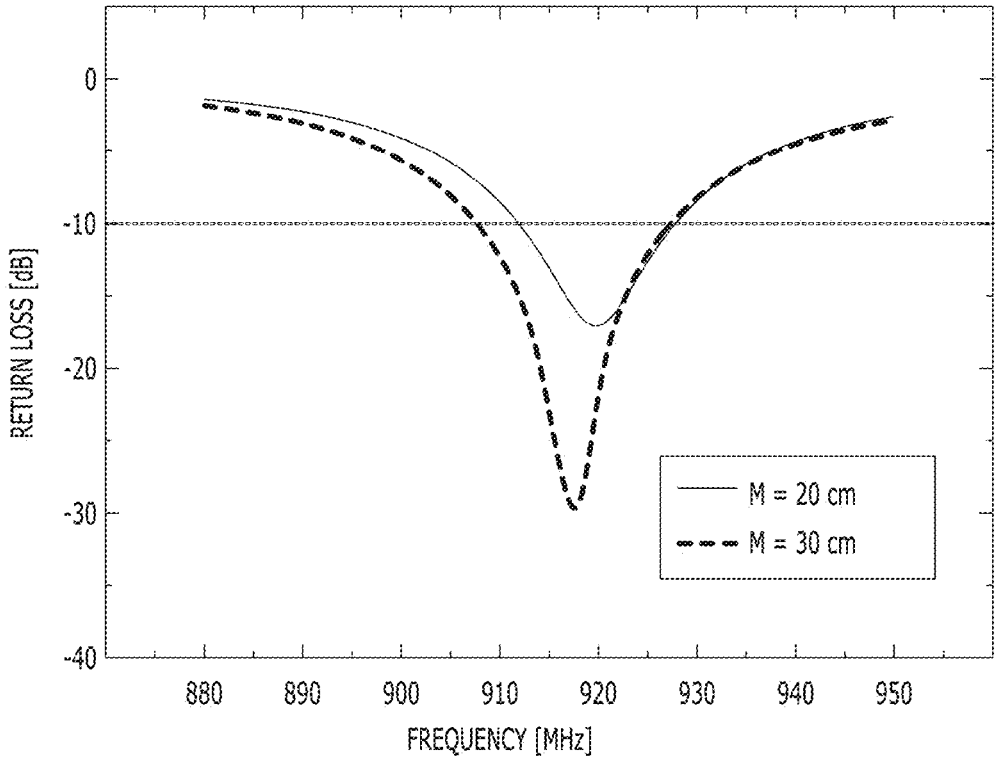
FIG. 10 is a graph illustrating frequency characteristics of an antenna when the main body shown in FIG. 8 is applied to a manhole cover.

FIG. 10 is a graph illustrating frequency characteristics of an antenna when the main body illustrated in FIG. 8 is applied to a manhole cover.

FIG. 10 shows results of frequency characteristics when an antenna manufactured with the main body structure of FIG. 8 or 9 is applied to a manhole cover.

The main body of the manhole cover type omnidirectional antenna is manufactured smaller than a manhole diameter M in consideration of a typical sluice valve manhole diameter M. When looking into return loss with respect to frequency, the manhole cover type omnidirectional antenna having the main body described above is well operated with bandwidths of about 14 MHz and 20 MHz with respect to a center frequency 920 MHz.

FIGS. 11 to 14 are graphs illustrating radiation characteristics associated with antenna gains and radiation patterns of manhole cover type omnidirectional antennas depending on manhole diameters.

Figure 11:
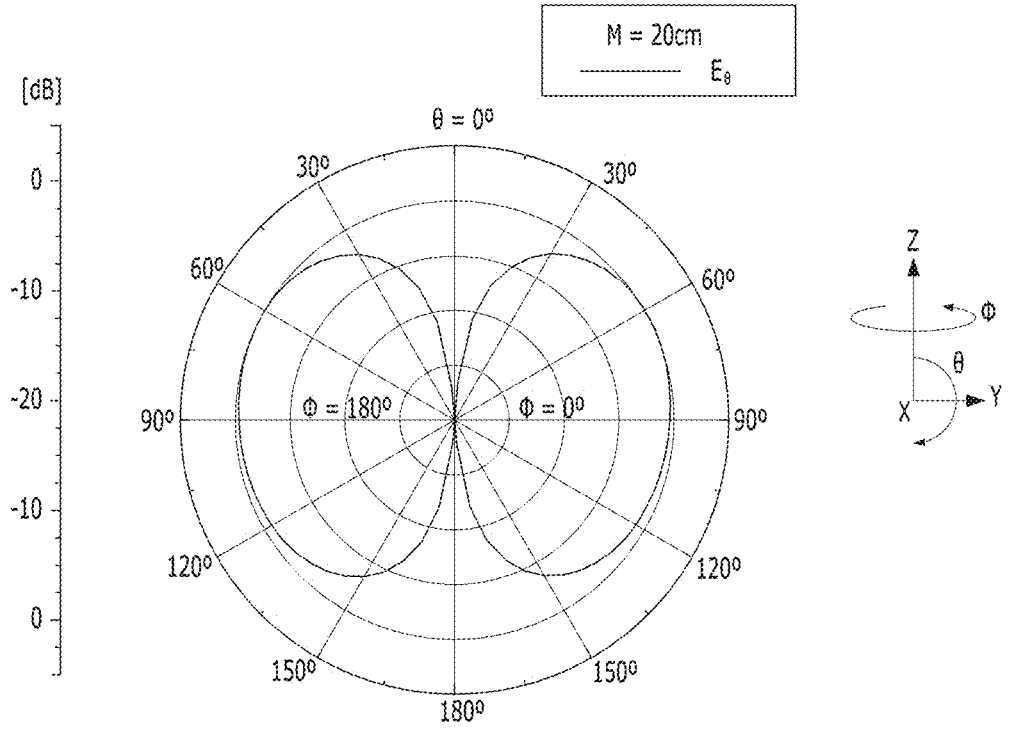
FIGS. 11 to 14 are graphs illustrating radiation characteristics related to an antenna gain and a radiation pattern of a manhole cover type omnidirectional antenna depending on manhole diameters.
Figure 12:
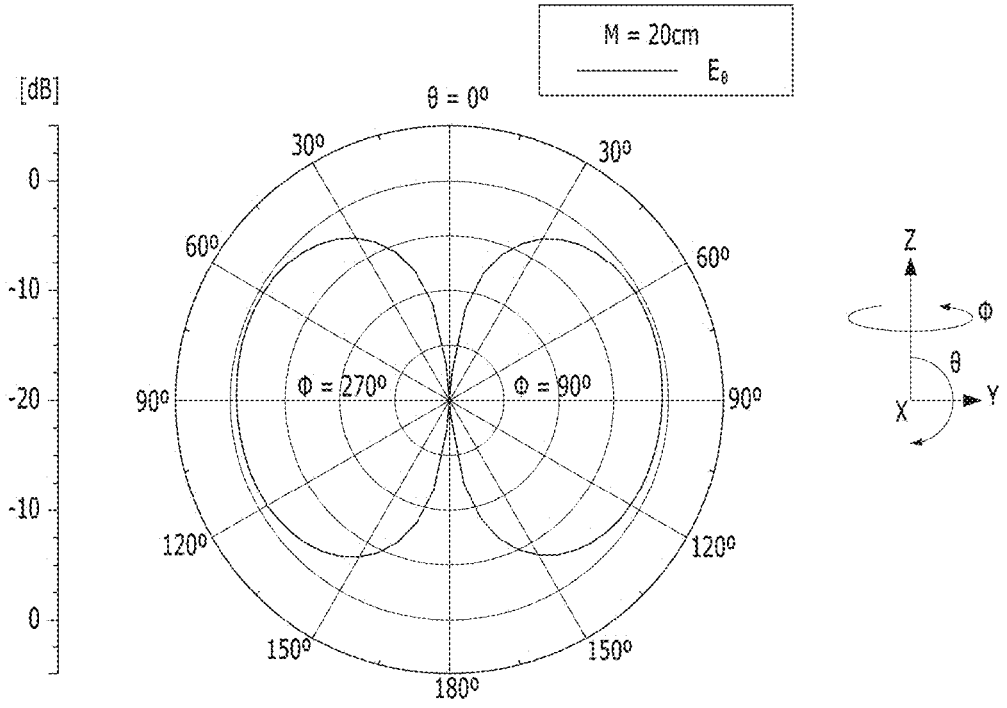

FIGS. 11 and 12 are the cases in which the manhole diameter M of FIG. 10 is 20 cm, and an antenna gain dB and a radiation pattern corresponding to electric field strength $E_\theta$ of a vertical plane exhibit omnidirectional characteristics.

Figure 13:
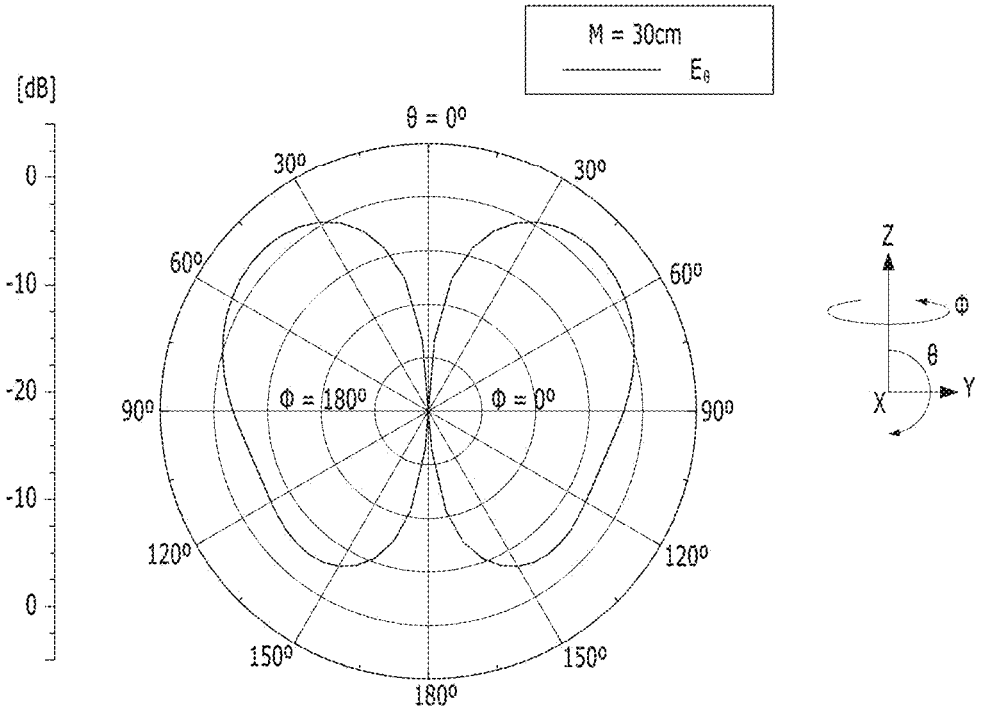
Figure 14:
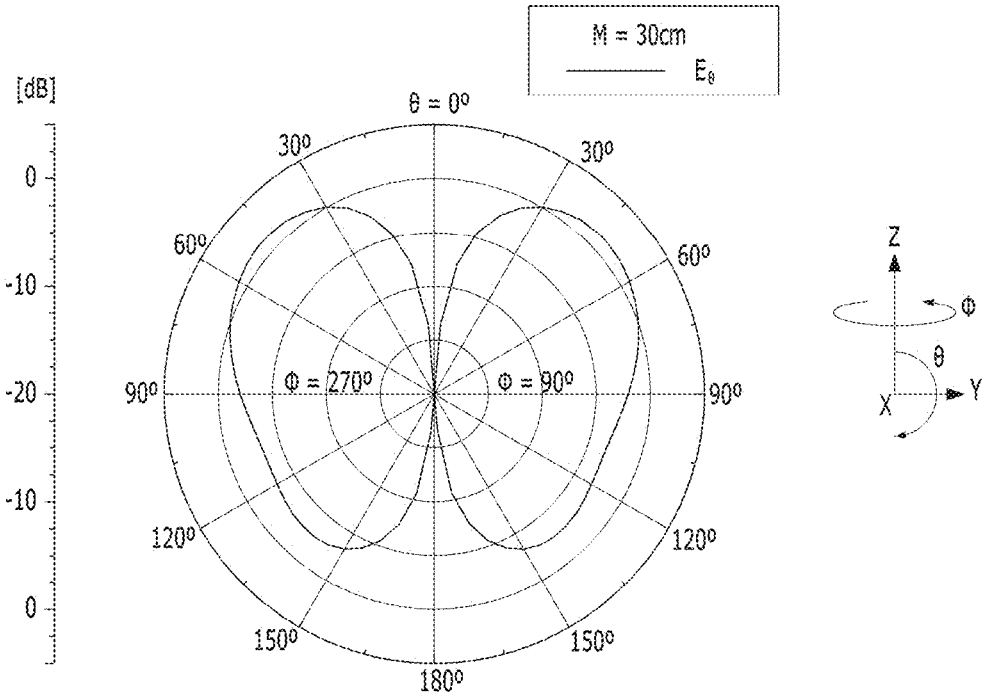

FIGS. 13 and 14 show that, even when the manhole diameter M of FIG. 10 is 30 cm, an antenna gain dB which is very suitable degree for a wireless sensor network or a wireless wide area network is achieved and a radiation pattern also is exhibiting omnidirectional characteristics.

Figure 16:
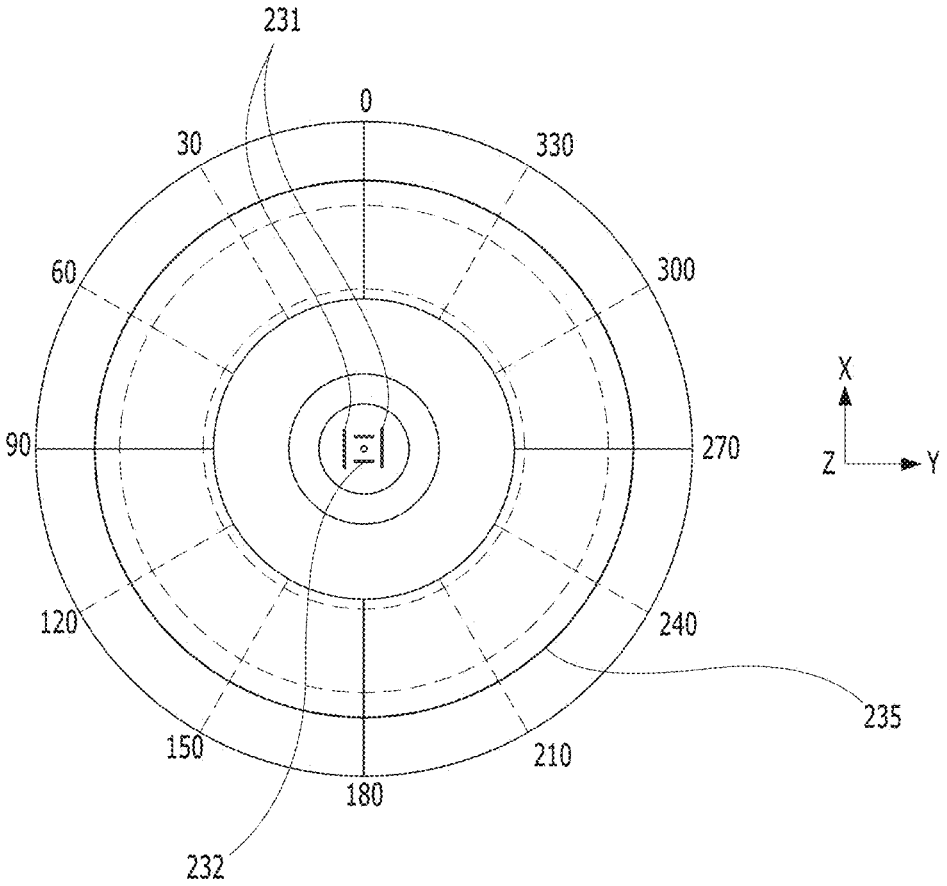
FIG. 16 is a graph for describing a formation shape of a radiation pattern of a manhole cover type omnidirectional antenna.

FIG. 15 is a graph for describing a formation shape of a radiation pattern of a conventional antenna according to a comparative example of the present invention, and FIG. 16 is a graph for describing a formation shape of a radiation pattern of the manhole cover type omnidirectional antenna illustrated in FIG. 2 or FIG. 8.

Referring to FIG. 15, the shorting strips 53 of a comparative example according to a conventional technology are disposed symmetrically to a metal pole 52 of the comparative example. Such a comparative example relates to a radiating portion without having slots with technical features such as those in the first embodiment or the second embodiment. In the comparative example, when the main body is installed in a cavity 51 of a manhole cover 50 to perform an antenna function, based on the horizontal plane or the X-Y plane, there occurs a problem in that omnidirectional characteristics are not exhibited because the main radiation shape 54 of the comparative example forms not an omnidirectional shape but an 8 shape. The main radiation shape 54 is formed in an 8 shape in a direction perpendicular to an arrangement direction of the shorting strips 53 of the comparative direction. Here, this is because, in a current distribution of the radiating portion of the comparative example, much mutual coupling occurs with cavity edges of the manhole at edges of the perpendicular direction.

On the other hand, referring to FIG. 16, to resolve the above-described problem and to realize omnidirectional characteristics, the slots 231 are symmetrically disposed in a direction perpendicular to the shorting strips 240. As described with FIG. 3, positions of the slots 231 (for example, a separation distance from the feeding point to the slots) and lengths of the slots 231 are adjusted until a radiation shape 235 exhibits omnidirectional characteristics by the embodiments of the present invention.

As in FIG. 16, adjusting the positions and lengths of the slots 231 may form the radiation shape 235 having omnidirectional characteristics.

Distribution of a surface current at an edge of the upper plate serving as the radiation portion becomes uniform due to the slots 231, the surface current of the edge of the upper plate serving as the radiation portion mutually couples with an edge of the cavity of the manhole, and thereby the omnidirectional characteristics can be exhibited. Particularly, the positions and lengths of the slots are changed to correspond to the positions and lengths of the shorting strips 240, and thereby the radiation shape 235 may be changed.

Figure 17:
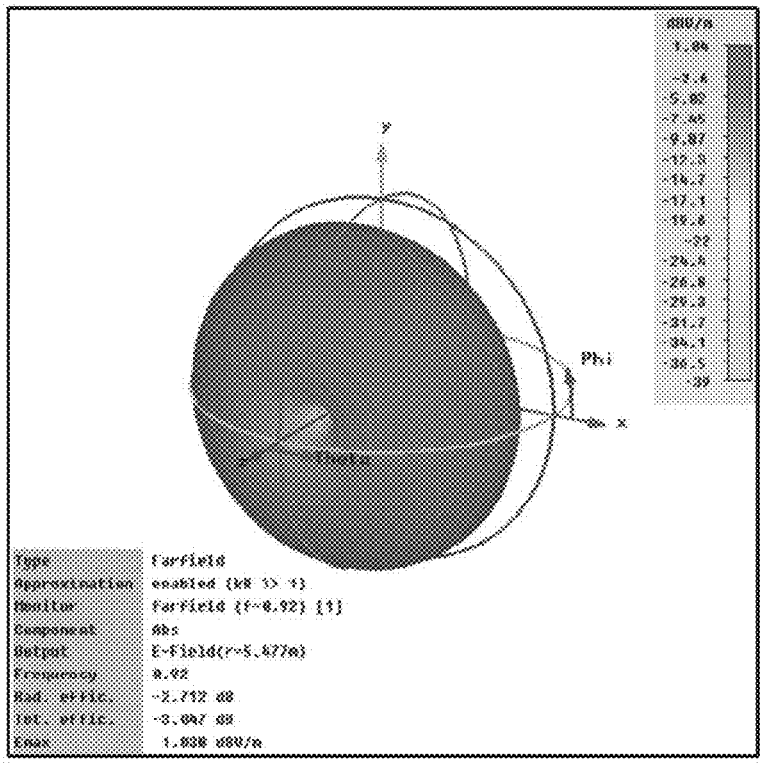
FIG. 17 is a three-dimensional graph resulting from a radiation characteristics experiment for a manhole cover type omnidirectional antenna installed in a manhole cover.

FIG. 17 is a three-dimensional graph resulting from a radiation characteristics experiment for a manhole cover type omnidirectional antenna installed in a manhole cover.

Referring to FIG. 17, the antenna and the manhole cover according to the embodiment of the present invention manufactured as a prototype using features of manufacturing and design methods of the antenna described in detail as above have a diameter of a typical sluice valve manhole and exhibits an omnidirectional radiation shape as shown in the experimental result of FIG. 17 even when the antenna and the manhole are installed on an X-Y plane which is the Earth's surface.

From the experimental result of FIG. 17, it is confirmed that the present invention provides sufficiently reliable radiation quality to meet requirements of a wireless sensor network.

As described above, the present invention according to the second embodiment and the first embodiment can be very suitable for a wireless sensor network or a wireless wide area network for remotely collecting and managing sensing information from various sensors in an underground space.

That is, when a main body, that is, an antenna is manufactured and installed in a manhole cover according to the descriptions of the present embodiments, wireless communication up to a ground position at a long distance from the manhole is possible. Sensing information inside the manhole at a long distance can be collected and managed by a wireless network. A large area information network can be formed over a network.

By applying the manhole cover type omnidirectional antenna according to the embodiments of the present invention in a planar-type multi-plate structure provided with the upper plate and the lower plate in parallel with the metal pole and the shorting strips interposed therebetween to the manhole cover, wireless communication up to a ground position at a long distance from the manhole is possible, thereby helping collect and manage the sensing information collected from a plurality of sensors inside the manholes at a long distance by forming a wireless sensor network or a wireless wide area network.

The manhole cover type omnidirectional antenna according to the embodiments of the present invention having a small angle between the main beam direction and the Earth's surface and having omnidirectional characteristics can relatively enhance actual communication distance with respect to a distance between the main body and a gateway, thereby providing an effect of forming a large area information network over a network including a wireless sensor network operated with small power and a wireless wide area network.

The manhole cover type omnidirectional antenna according to the embodiments of the present invention can wirelessly acquire sensing information without needing to directly approach manholes at locations on roads of a downtown area etc. which are not easy to approach, thereby having an advantage in terms of safety.

The manhole cover type omnidirectional antenna according to the embodiments of the present invention allows the main body to be installed inside a manhole cover at an equivalent level with the Earth's surface, has frequencies and bandwidth that enable seamless communication, has a relatively small radiation angle formed with respect to the Earth's surface compared to conventional technologies, can stably convert electrical signals into electromagnetic waves between the wireless transmitter connected to sensors in an underground space and a gateway on the ground, thereby having a very suitable advantage of forming a network between the underground space and the ground space by a wireless sensor network or a wireless wide area network.

The manhole cover type omnidirectional antenna according to the embodiments of the present invention is horizontally placed inside the cavity of the manhole cover, is smoothly operated inside the manhole cover formed of a metal because of being protected by the radome inserted into the cavity to be at the same level as the upper surface of the manhole cover, thereby having an advantage of being used as a product that is relatively long in actual communication distance or has great antenna gain.

The manhole cover type omnidirectional antenna according to the embodiments of the present invention has an advantage of excellent applicability and usability even when an installation height of a gateway installed at a position spaced apart from a manhole cover installed at an arbitrary position is almost close to the Earth's surface because the antenna is installed and assembled in the cavity of the manhole cover to have omnidirectional characteristics, the angle formed between the main beam direction and the Earth's surface is relatively small compared to an existing product, and the main body is relatively small in diameter and thickness compared to a diameter and a thickness of a typical manhole cover.

The above description of embodiments is merely for describing technical sprit of the present invention, and those having ordinary skill in the art should understand that various changes and modifications may be made therein without departing from the spirit and features of the present invention. Accordingly, the above described embodiments of the present invention should be considered in a descriptive sense only and not in a limitative sense. The scope of the present invention is not limited by the above-described embodiments. The scope of the present invention should be interpreted only according to the attached claims, and it should be understood that all technical ideas within an equivalent scope thereof should be interpreted as being included in the scope of the present invention.

REFERENCE NUMERALS

| | |
|---|---|
| 100: MANHOLE COVER | 110: CAVITY |
| 120: CABLE HOLE | 200, 200a: MAIN BODY |
| 210, 210a: LOWER PLATE | 220: METAL POLE |
| 230, 230a: UPPER PLATE | 240, 240a: SHORTING STRIP |
| 300: RADOME | 400: CONNECTOR |
| 500: GATEWAY | 600: WIRELESS TRANSMITTER |
| 700: SENSOR | 800: CABLE |

What is claimed is:

1. A manhole cover type omnidirectional antenna comprising:

a manhole cover installed in a manhole in the Earth's surface;

a main body installed in a cavity of an upper surface of the manhole cover and configured to convert an electrical signal into an electromagnetic wave to wirelessly communicate with a gateway separated from the manhole cover; and a radome inserted into the cavity to cover the main body, wherein the main body includes:

a lower plate and an upper plate parallel to the lower plate, a plurality of shorting strips connecting the upper plate and the lower plate, the plurality of shorting strips connected to the upper plate in a length-wise direction; and a plurality of slots formed in the upper plate to be spaced apart from the shorting strips, the plurality of slots being symmetrically disposed in a direction perpendicular to the length-wise direction of the plurality of shorting strips.

2. The antenna of claim 1, further comprising a connector connected to a cable which electrically connects the main body and a wireless transmitter.

3. The antenna of claim 1, wherein the main body has a monopole shape with a thickness thinner than a thickness of the manhole cover, wherein the main body achieves impedance matching using the plurality of shorting strips to have an antenna performance in which an angle of a main beam direction with respect to the Earth's surface is small, and the main body has omnidirectional radio frequency transmission characteristics at a horizontal plane.

4. The antenna of claim 2, wherein the wireless transmitter is connected to a plurality of sensors disposed inside the manhole and provides the electrical signal corresponding to sensing information input from the sensors to the main body via the cable and the connector.

5. The antenna of claim 2, wherein the cavity includes:

a circular side surface disposed in the manhole cover and having a cavity diameter smaller than a diameter of the manhole cover but greater than a diameter of the main body;

a lower surface horizontally connected to the side surface at a smaller depth than a thickness of the manhole cover; and a cable hole through which the connector is inserted or the cable is passed.

6. The antenna of claim 5, wherein the main body has a main body diameter formed to be smaller than the cavity diameter.

7. The antenna of claim 2, wherein the lower plate is disposed on a lower surface of the cavity of the manhole cover over a cable hole of the manhole cover into which the connector is inserted, the lower plate configured to serve as a ground surface based on a electrical charge being provided to the upper plate, wherein the antenna further comprises a metal pole which extends from the connector, passes through the lower plate, and extends in a vertical direction up to a height corresponding to a gap between the lower plate and the upper plate, wherein the upper plate is connected to an upper end of the metal pole and has a same diameter as the lower plate, and wherein the upper plate configured to serve as a radiator based on the electrical charge being provided to the upper plate;

wherein the plurality of shorting strips connect the upper plate and the lower plate at a position spaced apart from the metal pole; and wherein the plurality of slots are spaced apart from the metal pole at positions not overlapping the plurality of shorting strips.

8. The antenna of claim 7, wherein the upper plate uses a point at which the upper plate and the upper end of the metal pole are connected to each other as a feeding point.

9. The antenna of claim 7, wherein the upper plate is short-circuited with respect to the lower plate through the shorting strip.

10. The antenna of claim 7, wherein the main body is formed as a planar-type multi-plate structure by the upper plate and the lower plate parallel to each other with the metal pole and the shorting strip interposed between the upper plate and the lower plate.

11. The antenna of claim 7, wherein the main body converts the electrical signal received from the connector into the electromagnetic wave corresponding to a shape of the planar-type multi-plate structure to form a small angle between the main beam direction of the electromagnetic wave and the Earth's surface and to have omnidirectional characteristics.

12. The antenna of claim 7, wherein the main body forms a large area information network over a network.

13. The antenna of claim 7, wherein an upper portion of each of the plurality of shorting strips is inserted into an upper connection hole of the upper plate and a lower portion of each of the plurality of shorting strips is inserted into a lower connection hole of the lower plate.

14. A manhole cover type omnidirectional antenna comprising:

a lower plate installed in a cavity of an upper surface of a manhole cover;

a connector installed at the lower plate and connected to a cable for a wireless transmitter;

an upper plate parallel to the lower plate;

a metal pole with a lower end thereof connected to the connector which passes through the lower plate and extends in a vertical direction up to a height corresponding to a gap between the lower plate and the upper plate, such that the upper plate is connected to an upper end of the metal pole;

a shorting strip connecting the upper plate and the lower plate at a position spaced apart from the metal pole; and a radome inserted into the cavity to cover the main body upper plate and the lower plate.

15. The antenna of claim 14, wherein the radome further includes a coupling cavity portion having a diameter and thickness which correspond to a diameter and a thickness of the cavity, the coupling cavity portion formed in the radome to accommodate the upper plate, the lower plate, the metal pole, and the shorting strip.

16. The antenna of claim 14, wherein the upper plate includes a slot formed in the upper plate spaced apart from the metal pole at a location that does not overlap the shorting strip.

17. The antenna of claim 14, wherein the shorting strip includes:

a short circuit portion which short-circuits the upper plate and the lower plate; and a pillar portion in contact with a lower surface or an upper surface of the upper plate and an upper surface or a lower surface of the lower plate and configured to support the upper plate on the basis of the lower plate.

18. The antenna of claim 14, wherein the upper plate includes:

a first substrate supported by the shorting strip, formed in a circular shape, and configured to serve as a dielectric; and a circular patch portion attached to an upper surface of the first substrate and having a feeding pattern connected to the metal pole and a radiation pattern connected to the feeding pattern to convert an electrical signal into an electromagnetic wave.

19. The antenna of claim 17, wherein the lower plate includes:

a second substrate disposed separately from a lower side of the upper plate by the shorting strip; and a ground surface attached to a lower surface or upper surface of the second substrate and electrically connected to the short circuit portion of the shorting strip.

* * * * *